US010309003B2

(12) United States Patent
Matsui et al.

(10) Patent No.: US 10,309,003 B2
(45) Date of Patent: Jun. 4, 2019

(54) HONEYCOMB STRUCTURE, AND MANUFACTURING METHOD OF THE SAME

(71) Applicant: NGK INSULATORS, LTD., Nagoya (JP)

(72) Inventors: Shiho Matsui, Nagoya (JP); Takayuki Inoue, Nagoya (JP); Kouhei Yamada, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 29 days.

(21) Appl. No.: 15/454,078

(22) Filed: Mar. 9, 2017

(65) Prior Publication Data

US 2017/0283931 A1 Oct. 5, 2017

(30) Foreign Application Priority Data

Mar. 29, 2016 (JP) ..... 2016-066876

(51) Int. Cl.

| | |
|---|---|
| ***C23C 4/12*** | (2016.01) |
| ***C23C 4/10*** | (2016.01) |
| ***H05B 3/12*** | (2006.01) |
| ***C23C 4/04*** | (2006.01) |

(52) U.S. Cl.

CPC ..... *C23C 4/12* (2013.01); *C23C 4/04* (2013.01); *C23C 4/10* (2013.01); *H05B 3/12* (2013.01); *H05B 2203/024* (2013.01)

(58) Field of Classification Search

CPC combination set(s) only.
See application file for complete search history.

(56) References Cited

U.S. PATENT DOCUMENTS

| | | | | |
|---|---|---|---|---|
| 7,011,803 | B2 | 3/2006 | Ichikawa et al. | |
| 8,803,043 | B2 | 8/2014 | Sakashita et al. | |
| 2003/0134084 | A1 | 7/2003 | Ichikawa et al. | |
| 2008/0229931 | A1* | 9/2008 | Katsuyama ..... | B01D 46/0078 96/417 |
| 2012/0003420 | A1* | 1/2012 | Betsushiyo ..... | C04B 35/573 428/116 |
| 2012/0076698 | A1* | 3/2012 | Ishihara ..... | B01D 53/00 422/174 |
| 2013/0043236 | A1 | 2/2013 | Sakashita et al. | |

FOREIGN PATENT DOCUMENTS

| | | | |
|---|---|---|---|
| JP | 4136319 | B2 | 8/2008 |
| JP | 2014-073434 | A1 | 4/2014 |
| WO | 2011/125815 | A1 | 10/2011 |

* cited by examiner

*Primary Examiner* — Satya B Sastri
(74) *Attorney, Agent, or Firm* — Burr & Brown, PLLC

(57) ABSTRACT

The honeycomb structure includes a pillar-shaped honeycomb structure body having porous partition walls 1 defining a plurality of cells and a circumferential wall, and a pair of electrode members disposed on the side of a side surface of the honeycomb structure body. The pair of electrode members contain metal silicon and boron, at least a part of the electrode member is made of a composite material including, as a main component, silicon containing 100 to 10000 ppm of boron in silicon. In the composite material which is comprised the electrode member, a volume ratio of the silicon containing 100 to 10000 ppm of the boron in the composite material is 70 volume % or more. An electric resistivity of the electrode member made of the composite material is from 20 μΩcm to 0.1 Ωcm.

10 Claims, 4 Drawing Sheets

HONEYCOMB STRUCTURE, AND MANUFACTURING METHOD OF THE SAME

"The present application is an application based on JP-2016-066876 filed on Mar. 29, 2016 with Japan Patent Office, the entire contents of which are incorporated herein by reference."

BACKGROUND OF THE INVENTION

Field of the Invention

The present invention relates to a honeycomb structure, and a manufacturing method of the honeycomb structure. More particularly, it relates to a honeycomb structure which is a catalyst carrier and also functions as a heater when a voltage is applied thereto, and has especially an excellent energization durability and an excellent thermal shock resistance of electrode members, and a manufacturing method of the honeycomb structure.

Description of the Related Art

Heretofore, a honeycomb structure which is made of cordierite and onto which a catalyst is loaded has been used in treatment of harmful substances included in an exhaust gas emitted from a car engine. Furthermore, it is also known that a honeycomb structure formed by a silicon carbide sintered body is used in purification of an exhaust gas (for example, see Patent Document 1).

When the exhaust gas is treated by the catalyst loaded onto the honeycomb structure, a temperature of the catalyst is needed to be raised up to a predetermined temperature. However, at start of the engine, the catalyst temperature is low, which has caused the problem that the exhaust gas cannot sufficiently be purified.

Therefore, it has been suggested that a honeycomb structure made of ceramics is used as "a heatable catalyst carrier" (for example, see Patent Document 2). Such a honeycomb structure generates heat due to Joule heat when a current is passed through the honeycomb structure, and hence its use as, for example, an electrically heated catalyst converter for exhaust gas purification has been studied. For example, a honeycomb structure described in Patent Document 2 includes a honeycomb structure body having porous partition walls and a circumferential wall positioned at an outermost circumference, and a pair of electrode members disposed on a side surface of this honeycomb structure body. As a material of the honeycomb structure body and electrode members, for example, a conductive ceramic material such as silicon carbide or a silicon-silicon carbide composite material is used. Hereinafter, the electrically heated catalyst converter will be referred to as "EHC" sometimes. The "EHC" is an abbreviation for "an electrically heated catalyst". Furthermore, silicon carbide will be referred to as "SiC" sometimes. The silicon-silicon carbide composite material will be referred to as "the Si—SiC composite material" sometimes.

Furthermore, electrode members of the electrically heated catalyst converter are also variously studied. For example, as the electrode members of the electrically heated catalyst converter, there are disclosed electrode members each including a first metal phase of an Ni—Cr alloy or the like, a second metal phase including Si as a main component, and an oxide phase made of an oxide mineral having a layer structure (see Patent Document 3). In the electrode members of the electrically heated catalyst converter described in Patent Document 3, the above-mentioned oxide phase is present in a dispersed state in the first metal phase and the second metal phase. Further, according to this electrode member, the first metal phase, the second metal phase and the oxide phase are present at specific area ratios in a cross section of the electrode member. As the oxide mineral included in the electrode member, bentonite or mica is used. It is to be noted that the electrode member described in Patent Document 3 is formed by thermal spraying.

[Patent Document 1] JP 4136319
[Patent Document 2] WO 2011/125815
[Patent Document 3] JP-A-2014-73434

SUMMARY OF THE INVENTION

As to an electrode member described in Patent Document 3, it is considered that even after a thermal load is periodically repeated, the electrode member is not peeled from a honeycomb structure body, and which enables an increase of an electric resistance value of the electrode member to be inhibited. However, in the electrode member described in Patent Document 3, which has caused the problem that in the periodically repeated thermal load, a portion of a first metal phase of Ni—Cr alloy or the like locally reaches a high temperature, this portion deteriorates or oxidizes and a resistance of the electrode member increases. Furthermore, due to a local deterioration or an oxidization of the electrode member, a heat generation distribution in the electrode member further deteriorates, and the electrode member formed by a thermal spraying might finally be fused.

The present invention has been developed in view of the above-mentioned problems. An object of the present invention is to provide a honeycomb structure which is a catalyst carrier and also functions as a heater when a voltage is applied thereto and which has especially an excellent energization durability and an excellent thermal shock resistance of an electrode member, and a manufacturing method of the honeycomb structure. It is to be noted that the energization durability of the electrode member is referred to as a durability of the electrode member to a thermal load by heat generation of the electrode member due to current supplying and is especially referred to as a durability of the electrode member to a thermal load by periodically repeated heat generation.

To achieve the above-mentioned object, according to the present invention, there are provided a honeycomb structure and a manufacturing method of the honeycomb structure as follows.

According to a first aspect of the present invention, a honeycomb structure is provided including a pillar-shaped honeycomb structure body and a pair of electrode members disposed on the side of a side face of the honeycomb structure body, wherein the honeycomb structure body has porous partition walls and a circumferential wall disposed at an outermost circumference, and in the honeycomb structure body, the partition walls define a plurality of cells extending from a first end face of the honeycomb structure body to a second end face thereof, the honeycomb structure body is made of a material containing silicon carbide, and a pair of electrode members contain metal silicon and boron, at least a part of the electrode member is made of a composite material including, as a main component, silicon containing 100 to 10000 ppm of boron in silicon, and in the composite material, a volume ratio of the silicon containing 100 to 10000 ppm of the boron in the composite material is 70 volume % or more, and an electric resistivity of the electrode members made of the composite material is from 20 μΩcm to 0.1 Ωcm.

According to a second aspect of the present invention, the honeycomb structure according to the above first aspect is provided, wherein the electric resistivity of the electrode member is from 0.001 to 0.1 Ωcm after a heat treatment is performed at 1000° C. of an atmospheric temperature for 72 hours.

According to a third aspect of the present invention, the honeycomb structure according to the above first or second aspects is provided, wherein a thermal expansion coefficient of the electrode member is from 3.0 to $6.5\times10^{-6}$/K.

According to a fourth aspect of the present invention, the honeycomb structure according to any one of the above first to third aspects is provided, wherein the composite material which is comprised the electrode members contains at least one of a metal boride and a boride.

According to a fifth aspect of the present invention, the honeycomb structure according to the above fourth aspect is provided, wherein the metal boride is at least one selected from the group consisting of CrB, $CrB_2$, $ZrB_2$, $TaB_2$, $NbB_2$, WB, and MoB.

According to a sixth aspect of the present invention, the honeycomb structure according to the above fourth aspect is provided, wherein the boride is at least one of BN and $B_4C$.

According to a seventh aspect of the present invention, the honeycomb structure according to any one of the above first to sixth aspects is provided, further including a conductive intermediate layer made of a material containing at least one of silicon carbide and metal silicon between the side face of the honeycomb structure body and the electrode member.

According to an eighth aspect of the present invention, the honeycomb structure according to the above seventh aspect is provided, wherein an electric resistivity of the conductive intermediate layer is from 20 μΩcm to 5 Ωcm.

According to a ninth aspect of the present invention, the honeycomb structure according to any one of the above first to eighth aspects is provided, wherein in the honeycomb structure body, a porosity is from 30 to 60%, an average pore diameter is from 2 to 15 μm, a thickness of the partition walls is from 50 to 300 μm, a cell density is from 40 to 150 cells/$cm^2$, and an electric resistance between the pair of electrode members is from 0.1 to 100Ω.

According to a tenth aspect of the present invention, a manufacturing method of a honeycomb structure is provided, including a step of thermally spraying or applying an electrode member forming raw material to the side of a side face of a pillar-shaped honeycomb formed body or a honeycomb fired body obtained by firing the honeycomb formed body to form electrode members on the side of the side face of the honeycomb formed body or the honeycomb fired body, wherein a mixture including solid-like silicon and powder of at least one of a metal boride and a boride is used as the electrode member forming raw material and the mixture is thermally sprayed, or the applied mixture is heated at a temperature of 1400° C. or more to melt silicon in the mixture, thereby to form the electrode members.

A honeycomb structure of the present invention includes a pillar-shaped honeycomb structure body and a pair of electrode members disposed on the side of a side surface of this honeycomb structure body. Further, in the honeycomb structure of the present invention, the honeycomb structure body is made of a material containing silicon carbide. Furthermore, the pair of electrode members contains metal silicon and boron. Further, at least a part of the electrode member is made of a composite material including, as a main component, silicon containing 100 to 10000 ppm of boron in silicon. In the composite material, a volume ratio of silicon containing 100 to 10000 ppm of boron in the composite material is 70 volume % or more. Further, an electric resistivity of the electrode member made of the composite material is from 20 μΩcm to 0.1 Ωcm.

The honeycomb structure of the present invention is a catalyst carrier and also functions as a heater when a voltage is applied thereto. Especially, in the honeycomb structure of the present invention, the electric resistivity of the electrode member is very low. Furthermore, the honeycomb structure of the present invention exhibits the effect that the electrode member is excellent in an energization durability and a thermal shock resistance. Especially, the electrode member of the honeycomb structure of the present invention is excellent in an oxidation resistance to a thermal load. Consequently, even when the electrode member of the honeycomb structure receives a thermal load due to heat generation by periodically repeated energization, the electrode members are hard to be peeled from the honeycomb structure body, and deterioration or the like of the electrode member is effectively prevented.

Furthermore, the manufacturing method of the honeycomb structure of the present invention is a manufacturing method to manufacture the above-mentioned honeycomb structure of the present invention, and the honeycomb structure of the present invention can be easily manufactured and can be manufactured at low cost.

DESCRIPTION OF THE PREFERRED EMBODIMENTS

Next, embodiments to carry out the present invention will be described in detail with reference to the drawings. It should be understood that the present invention is not limited to the following embodiments, and design changes, improvements and others are suitably added on the basis of ordinary knowledge of a person skilled in the art without departing from the gist of the present invention.

Figure 1:
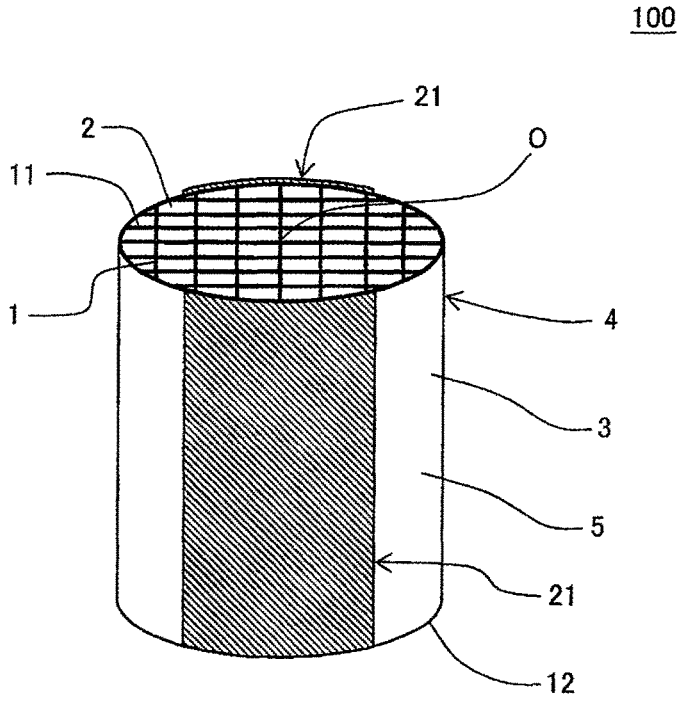
FIG. 1 is a perspective view schematically showing a honeycomb structure according to an embodiment of the present invention.
Figure 2:
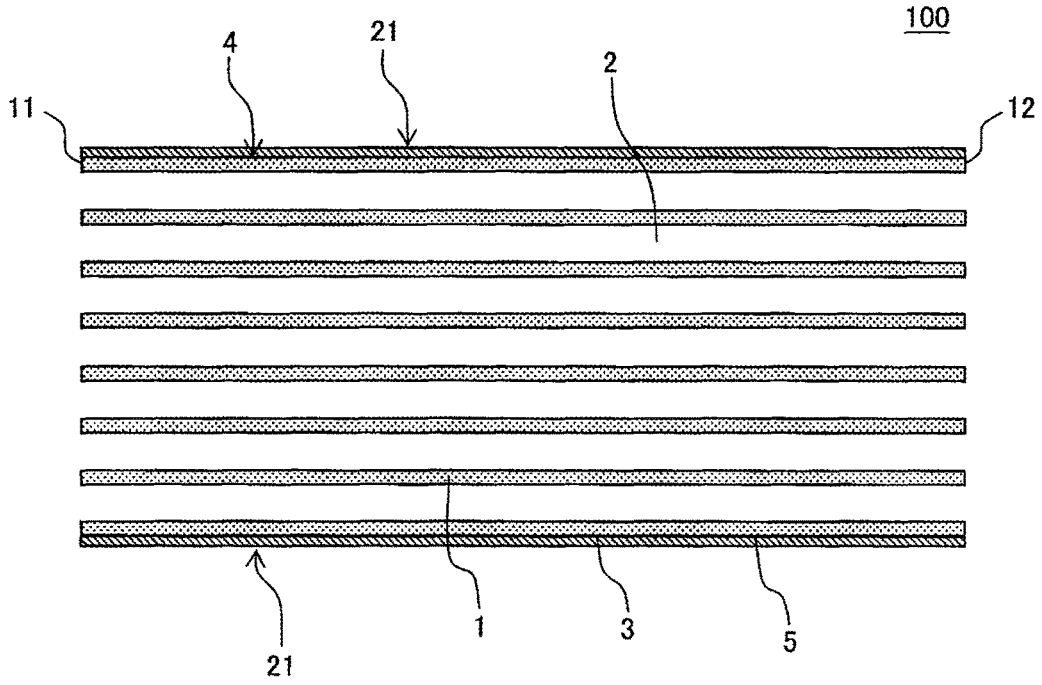
FIG. 2 is a schematic view showing a cross section which is parallel to a cell extending direction of a honeycomb structure according to an embodiment of the present invention.
Figure 3:
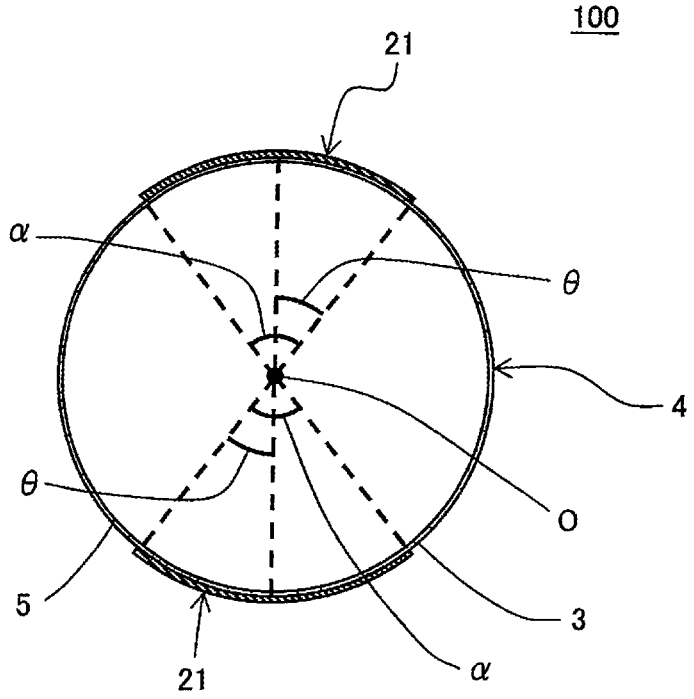
FIG. 3 is a schematic view showing a cross section which is perpendicular to the cell extending direction of the honeycomb structure according to an embodiment of the present invention.

(1) Honeycomb Structure:

As shown in FIG. 1 to FIG. 3, a honeycomb structure according to an embodiment of the present invention is a honeycomb structure 100 which includes a pillar-shaped honeycomb structure body 4, and a pair of electrode members 21 and 21 disposed on the side of a side surface 5 of the honeycomb structure body 4. The honeycomb structure body 4 has porous partition walls 1 and a circumferential wall 3 positioned at an outermost circumference. In the honeycomb structure body 4, there are defined a plurality of cells 2 which function as through channels for a fluid and extend from a first end face 11 of one end face of the honeycomb structure body 4 to a second end face 12 of the other end face. It is to be noted that the mean of "The pair of electrode members 21 and 21 are disposed on the side of the side surface 5 of the honeycomb structure body 4" is that the pair of electrode members 21 and 21 are directly disposed on the side surface 5 of the honeycomb structure body 4, and additionally, that another element having conductivity is interposed between the electrode members 21 and 21.

In the honeycomb structure 100 of the present embodiment, the honeycomb structure body 4 is made of a material containing silicon carbide. Furthermore, in the honeycomb structure 100 of the present embodiment, the pair of electrode members 21 and 21 contains metal silicon and boron. Further, at least a part of the pair of electrode members 21 and 21 is made of a composite material including, as a main component, silicon containing 100 to 10000 ppm of boron in silicon. Further, in the above-mentioned composite material comprised in the electrode member 21, a volume ratio of "silicon containing 100 to 10000 ppm of boron" in the composite material is 70 volume % or more. Hereinafter, the above-mentioned "silicon containing 100 to 10000 ppm of boron in silicon" will be referred to as "boron-containing silicon" sometimes. Furthermore, "the composite material including boron-containing silicon as the main component" will be referred to as "the specific composite material" sometimes. That is, the specific composite material is referred to as a material that a ratio of a volume of boron-containing silicon to a volume of the specific composite material is 70 volume % or more. The main component of the specific composite material means the component that a ratio of a volume of the component in the specific composite material is 70 volume % or more. Furthermore, an electric resistivity of the electrode member 21 made of this specific composite material is from 20 μΩcm to 0.1 Ωcm.

The honeycomb structure 100 of the present embodiment is a catalyst carrier and also functions as a heater when a voltage is applied thereto. Especially, the honeycomb structure 100 of the present embodiment includes the electrode member 21 containing such a specific composite material as described above, and hence the electric resistivity of the electrode member 21 is low. Furthermore, the honeycomb structure 100 of the present embodiment includes the electrode member 21 containing the above-mentioned specific composite material, and hence the electrode member 21 is excellent in an energization durability and a thermal shock resistance. Especially, the electrode member 21 of the honeycomb structure 100 of the present embodiment is excellent in an oxidation resistance to a thermal load. Consequently, even when the electrode member 21 of the honeycomb structure 100 receives the thermal load due to heat generation during periodically repeated energizations, the electrode member 21 containing the specific composite material is hard to be peeled from the honeycomb structure body 4, and a deterioration or the like of the electrode member 21 is effectively prevented.

The reason why the electrode member 21 containing the specific composite material is excellent in an oxidation resistance is that metal silicon (Si) is used as a material of the electrode member 21. Containing a specific amount of boron in this metal silicon enables the electric resistivity of silicon to be reduced. Hereinafter, the containing of boron in silicon will be referred to as "doping with boron in silicon" sometimes. Furthermore, a content of boron in silicon will be referred to as "an amount of boron to be doped" when boron is doped in silicon. If the amount of boron to be doped is excessively small, the electric resistivity of the electrode member might not sufficiently be reduced. Furthermore, if the amount of boron to be doped is excessively large, a thermal expansion coefficient of the electrode member might be increased so that a difference in a thermal expansion is generated between the electrode member and a member in which the electrode member is disposed and which adversely affects a thermal durability.

Here, FIG. 1 is a perspective view schematically showing the honeycomb structure according to an embodiment of the present invention. FIG. 2 is a schematic view showing a cross section which is parallel to a cell extending direction of the honeycomb structure according to an embodiment of the present invention. FIG. 3 is a schematic view showing a cross section which is perpendicular to the cell extending direction of the honeycomb structure according to an embodiment of the present invention. It is to be noted that in FIG. 3, the partition walls are omitted.

In the honeycomb structure 100 of the present embodiment, at least a part of the pair of electrode members 21 and 21 may be made of "the specific composite material". For example, in a case where one of the pair of electrode members 21 and 21 is defined as "a first electrode member" and the other electrode member of the pair of electrode members 21 and 21 is defined as "a second electrode member", at least one of the first electrode member and the second electrode member may be made of "the specific composite material". Furthermore, a part of the first electrode member or a part of the second electrode member may be made of "the specific composite material".

In the specific composite material, "the volume ratio of boron-containing silicon" in this specific composite material is 70 volume % or more. When the volume ratio of boron-containing silicon is smaller than 70 volume %, the energization durability and thermal shock resistance of the electrode member made of the specific composite material deteriorate. The volume ratio of boron-containing silicon is preferably from 70 to 98 volume %, further preferably from 80 to 98 volume %, and especially preferably from 80 to 92 volume %. According to such a constitution, the energization durability and thermal shock resistance of the electrode members become more suitable.

Furthermore, it is important that "boron-containing silicon" included in the specific composite material which is comprised the electrode members is silicon containing 100 to 10000 ppm of boron. When an amount of boron in silicon is smaller than 100 ppm or in excess of 10000 ppm, an effect of improving the energization durability and the thermal shock resistance of the electrode members do not sufficiently appear. The boron-containing silicon is silicon containing 100 to 10000 ppm of boron. However, An amount of boron in silicon is preferably from 200 to 7000 ppm, further preferably from 400 to 7000 ppm, and especially preferably from 400 to 6000 ppm. It is to be noted that the amount of boron in silicon is a ratio of the number of boron atoms in silicon to the number of silicon atoms.

"The volume ratio of boron-containing silicon" in the specific composite material can be measured by imaging a cross section of the electrode member of the honeycomb structure with a scanning electron microscope (SEM). Specifically, "the volume ratio of boron-containing silicon" in the specific composite material can be measured by the following method. It is to be noted that in the method described below a volume ratio of another component in the specific composite material can be simultaneously measured. First, the electrode member is cut to expose the cross section of the electrode member. Next, unevenness of the cross section of the electrode member is filled with a resin, and furthermore, the surface filled with the resin is polished. Next, the polished surface of the electrode member is observed, and an elementary analysis of the material which is comprised the electrode member is performed. The observation of the polished surface can be performed by an energy dispersive X-ray analysis. Hereinafter, the energy dispersive X-ray analysis will be referred to as "EDX analysis" sometimes. The "EDX" is an abbreviation for "energy dispersive X-ray spectroscopy".

Next, as to a portion discriminated as "silicon" in the polished surface, whether or not silicon contains "another element" is discriminated by the following method. As to a region where a silicon element is detected, a portion in which an element other than the silicon element is detected is discriminated as "the other component", with a sectional tissue photograph of the polished surface and mapping by EPMA analysis. The "EPMA" is an abbreviation for "an electron probe micro analyzer". It is to be noted that at this time, whether or not the discriminated silicon is "boron-containing silicon" is not discriminated. Examples of "the other element" include boron, and a metal boride or a boride which is present as a boron source in silicon.

Next, an observation is performed so that each component discriminated in the EPMA analysis is shaded by the scanning electron microscope. From observation results of 6 viewing fields at a magnification of 200 times, a ratio of each component is measured by an image processing software, and occupying ratios (area %) of silicon and the other components in the SEM image are obtained to define the value as a ratio of a volume (volume %) of each component. As the image processing software, "ImagePro (trade name)" manufactured by Nihon Visual Science, Inc. can be used.

Furthermore, in the EPMA analysis, the silicon element is only detected, or silicon and boron are detected, and as to the portion discriminated as "silicon", an amount of boron in silicon is specified by the following method.

First, the electrode member including the position discriminated as "silicon" is cut into about several millimeters, and a cross section of the cut electrode member is prepared by using a broad ion beam method, thereby preparing a sample to measure the amount of boron. The broad ion beam method is a preparing method of a sample cross section by use of an argon ion beam. Specifically, in the method, a shielding plate is disposed directly on the sample and is irradiated with a broad ion beam of argon to etch the sample, thereby preparing the cross section of the sample along an end face of the shielding plate. Hereinafter, the broad ion beam method will be referred to as "BIB method" sometimes. Next, as to the sample whose cross section is prepared, boron in silicon is analyzed by a time-of-flight secondary mass spectrometry (TOF-SIMS). In the time-of-flight secondary mass spectrometry, the sample is first irradiated with a primary ion beam, and secondary ions are emitted from the surface of the sample. Further, the emitted secondary ions are introduced into a time-of-flight mass spectrometer to obtain a mass spectrum of the outermost surface of the sample. Further, by the obtained mass spectrum, the sample is analyzed. It is to be noted that in the time-of-flight secondary mass spectrometry, the element analysis of B, Cr and the like in Si can be performed, and an amount (ppm) of B or Cr in Si is obtained by a conversion on the basis of a correlation between spectral intensity of B or Cr in Si and a concentration thereof.

The electric resistivity of the electrode member means the electric resistivity at 25° C. In the present specification, the electric resistivity of the electrode member is the electric resistivity at 25° C. unless otherwise specified. The electric resistivity of the electrode member can be measured by the following method. First, a measurement sample having a longitudinal size of 0.2 mm×a lateral size of 4 mm×a length of 40 mm is prepared from the electrode member. Hereinafter, the measurement sample to measure the electric resistivity of the electrode member will be referred to as "Measurement Sample 1". Furthermore, a direction from one end of a region where a length of Measurement Sample 1 is 40 mm toward the other end will be referred to as "a length direction of Measurement Sample 1" sometimes. Next, the whole surfaces of both end portions of Measurement Sample 1 in the length direction are coated with silver paste and wired to enable an energization. Next, Measurement Sample 1 is connected to a voltage applying current measuring device and a voltage is applied to Measurement Sample 1. A voltage of 10 to 200 V is applied, and a current value and a voltage value are measured in a state at 25° C., and the electric resistivity is calculated from the obtained current value and voltage value and the dimension of Measurement Sample 1. Furthermore, when the electrode member is smaller than the size of Measurement Sample 1 having the longitudinal size of 0.2 mm×the lateral size of 4 nm×the length of 40 mm and Measurement Sample 1 cannot be obtained, a smaller measurement sample is prepared as the measurement sample to measure the electric resistivity. In a case where the electrode member is further smaller and it is difficult to distinguish the electrode member from the honeycomb structure body, the electric resistivity of the electrode members together with the circumferential wall of the honeycomb structure body is measured, and the electric resistivity of Measurement Sample 1 is calculated from a ratio of a thickness of the electrode member to a thickness of the circumferential wall of the honeycomb structure body and the electric resistivity of the circumferential wall of the honeycomb structure body. In a case where it is difficult to sample Measurement Sample 1 due to the size, shape and the like of the electrode members of the honeycomb structure, a test piece may be made of the same material as in the electrode members, for use in measuring the electric resistivity.

The electrode members have an electric resistivity of 20 μΩcm to 0.1 Ωcm and have a low resistance. Such electrode members have the advantage that the honeycomb structure body can uniformly generate heat. A lower limit value of the electric resistivity of the electrode member is 20 μΩcm. However, the lower limit value of the electric resistivity of the electrode member is preferably 100 μΩcm and especially preferably 0.001 Ωcm. Furthermore, an upper limit value of the electric resistivity of the electrode member is 0.1 Ωcm. However, the upper limit value of the electric resistivity of the electrode member is preferably 0.09 Ωcm and especially preferably 0.05 Ωcm.

A value of the electric resistivity of the electrode member might change due to continuous use of the honeycomb structure. For example, in a case where the electrode members receive thermal loads due to the continuous use of the honeycomb structure, the electrode members might deteriorate or oxidize to increase the electric resistivity of the electrode members. In the honeycomb structure of the present embodiment, the electric resistivity of the electrode member is preferably from 0.001 to 0.1 Ωcm after a heat treatment is performed at 1000° C. of an atmospheric temperature for 72 hours. The above-mentioned heat treatment indicates characteristics concerning the oxidation resistance of the electrode members, which indicates that the electric resistivity of the electrode member of the honeycomb structure of the present embodiment is maintained in a range of 0.001 to 0.1 Ωcm also in the above-mentioned heat treatment. It is to be noted that a specific heat treatment method of the honeycomb structure is as follows. The honeycomb structure is thrown into an electric furnace and a temperature of the electric furnace rises from room temperature to 1000° C. at a rate of 300° C./hour. The atmosphere in the electric furnace is the air atmosphere. The honeycomb structure is held in a state where the temperature is raised up to 1000° C. for 72 hours and then the honeycomb structure is removed from the electric furnace. It is to be noted that the honeycomb structure removed from the electric furnace is cooled in the air atmosphere.

In the honeycomb structure 100 of the present embodiment, the specific composite material which is comprised at least a part of the electrode member 21 may contain at least one of a metal boride and a boride. The metal boride and boride become supply sources to contain boron in silicon which is the main component of the specific composite material. A ratio of a volume of the metal boride and boride to a volume of the specific composite material is smaller than 30%. The volume ratio of the metal boride and boride contained in the specific composite material can be obtained by the same manner as in the volume ratio of boron-containing silicon contained in the specific composite material. In the honeycomb structure of the present embodiment, the specific composite material which is comprised the electrode members does not preferably contain components other than the metal boride and boride which become the boron source, except for impurities which are inevitably present.

The metal boride contained in the specific composite material is preferably at least one selected from the group consisting of CrB, $CrB_2$, $ZrB_2$, $TaB_2$, $NbB_2$, WB, and MoB. When the specific composite material contains such a metal boride, silicon which is the main component of the specific composite material can effectively contain a predetermined amount of boron. Among the components illustrated as the metal borides, for example, "CrB" has a low electric resistivity of about 45 μΩcm, and in the electrode members made of the specific composite material containing CrB, an initial electric resistivity decreases as compared with the electrode members containing another component. Consequently, for example, in the electrode members made of the specific composite material containing CrB, even if CrB in the specific composite material oxidizes, an effect of inhibiting the increase of the electric resistivity of the electrode members can be easily obtained, because a silicon portion occupying a larger part of the specific composite material is doped with boron.

Furthermore, the boride contained in the specific composite material is preferably at least one of BN and $B_4C$. Also as to such a boride, the predetermined amount of boron in silicon which is the main component of the specific composite material can be effectively contained.

In a case where a part of the pair of electrode members is made of the specific composite material, the electrode member of a region other than the part made of the specific composite material may be made of, for example, conductive ceramic or metal except for the specific composite material. Examples of a material other than the specific composite material include a material containing at least one of silicon carbide and silicon, a material containing a metal silicide, and a material containing at least one of Ni and Cr.

A thermal expansion coefficient of the electrode member is preferably from 3.0 to $6.5\times10^{-6}$ (/K), further preferably from 3.5 to $6.5\times10^{-6}$ (/K), and especially preferably from 4.0 to $6.0\times10^{-6}$ (/K). When the thermal expansion coefficient of the electrode member is from 3.0 to $6.5\times10^{-6}$ (/K), a smaller difference in thermal expansion is only made between the electrode member and the honeycomb structure body, and the energization durability improves. For example, when the thermal expansion coefficient of the electrode member is smaller than $3.0\times10^{-6}$ (/K), a difference in thermal expansion is unfavorably made between the honeycomb structure body and the electrode member when a high-temperature exhaust gas flows inside. Furthermore, also in a case where the thermal expansion coefficient of the electrode member is in excess of $6.5\times10^{-6}$ (/K), the difference in thermal expansion is unfavorably made between the honeycomb structure body and the electrode member.

The thermal expansion coefficient of the electrode member means the thermal expansion coefficient at 25 to 800° C. In the present specification, the thermal expansion coefficient is the thermal expansion coefficient at 25 to 800° C. unless otherwise specified. The thermal expansion coefficient of the electrode member can be measured by the following method. First, a measurement sample having a longitudinal size of 0.2 mm×a lateral size of 4 mm×a length of 50 mm is prepared from the electrode member. Hereinafter, the measurement sample to measure the thermal expansion coefficient of the electrode member will be referred to as "Measurement Sample 2". Furthermore, a direction from one end of a region where a length of Measurement Sample 2 is 50 mm toward the other end is referred to as "a length direction of Measurement Sample 2" sometimes. Measurement Sample 2 is cut out and prepared from the electrode member of the honeycomb structure so that the cell extending direction of the honeycomb structure corresponds to the length direction of Measurement Sample 2. In a case where the electrode member is smaller than the size of Measurement Sample 2 having the longitudinal size of 0.2 mm×the lateral size of 4 mm×the length of 50 mm and Measurement Sample 2 cannot be obtained from the electrode member, a smaller measurement sample is prepared as the measurement sample to measure the thermal expansion coefficient. In a case where the electrode member is further smaller than the above mentioned size of Measurement Sample 2 and it is difficult to distinguish the electrode member from the honeycomb structure body, the thermal expansion coefficient of the electrode members together with the circumferential wall of the honeycomb structure body is measured, and the thermal expansion coefficient of Measurement Sample 2 is calculated from the ratio of the thickness of the electrode member to the thickness of the circumferential wall of the honeycomb structure body and the thermal expansion coefficient of the circumferential wall of the honeycomb structure body. Additionally, in a case where it is difficult to sample Measurement Sample 2 due to the size, shape and the like of the electrode members of the honeycomb structure, a test piece may be made of the same material as in the electrode members to be supplied for use in measuring the thermal expansion coefficient. As to Measurement Sample 2 prepared as described above, the thermal expansion coefficient at 25 to 800° C. is measured by a method based on JIS R 1618. The thermal expansion coefficient at 25 to 800° C. is measured in the length direction of Measurement Sample 2. As a thermal dilatometer, "TD5000S (trade name)" manufactured by Bruker AXS K.K. can be used. The thermal expansion coefficient of Measurement Sample 2 which is measured by the above method is "the thermal expansion coefficient of the electrode member at 25 to 800° C.".

There is not any special restriction on the thickness of the electrode member. For example, the thickness of the electrode member is preferably from 50 to 500 μm. When the thickness of the electrode member is from 50 to 500 μm, the honeycomb structure body easily uniformly generates heat, and the thermal shock resistance of the electrode member also becomes suitable. For example, when the thickness of the electrode member is smaller than 50 μm, it might be difficult for the honeycomb structure body to uniformly generate heat because the electrode member is excessively thin. Furthermore, when the thickness of the electrode member is in excess of 500 μm, an outer wall of the honeycomb structure in the vicinity of the electrode member is easily cracked and the thermal shock resistance might decrease. The thickness of the electrode member can be measured from an image obtained by imaging a cross section of the honeycomb structure which is vertical to the cell extending direction with the scanning electron microscope (SEM).

As shown in FIG. 1 to FIG. 3, each of the pair of electrode members 21 and 21 of the honeycomb structure 100 of the present embodiment is preferably formed into a band-like shape extending in the extending direction of the cells 2 of the honeycomb structure body 4. In the cross section perpendicular to the extending direction of the cells 2, 0.5 times of a central angle α of each of the electrode members 21 and 21 (i.e., an angle θ of 0.5 times of the central angle α) is preferably from 10 to 65° and further preferably from 30 to 60°. According to this constitution, the deviation of the current flowing inside of the honeycomb structure body 4 can be further efficiently controlled when a voltage is applied between the pair of electrode members 21 and 21. That is, the current flowing inside of the honeycomb structure body 4 can more uniformly flow. Consequently, the deviation of the heat generation inside of the honeycomb structure body 4 can be further efficiently controlled. As shown in FIG. 3, "the central angle α of the electrode member 21" is an angle formed by two line segments connecting both ends of the electrode member 21 to a center O of the honeycomb structure body 4 in the cross section perpendicular to the extending direction of the cells 2. In other words, "the central angle α of the electrode member 21" is an inner angle of a portion of the center O in a shape (for example, a fan shape) formed by "the electrode member 21", "the line segment connecting one end portion of the electrode member 21 to the center O" and "the line segment connecting the other end portion of the electrode member 21 to the center O".

Furthermore, "the angle θ of 0.5 times of the central angle α" of one electrode member 21 has a size of preferably 0.8 to 1.2 times and further preferably 1.0 time (an equal size) to "the angle θ of 0.5 times of the central angle α" of the other electrode member 21. In consequence, the deviation of the current flowing inside of the honeycomb structure body 4 can be further efficiently controlled when a voltage is applied between the pair of electrode members 21 and 21, and hence, the deviation of the heat generation inside of the honeycomb structure body 4 can be further efficiently controlled.

In the honeycomb structure 100 shown in FIG. 1 to FIG. 3, each of the pair of electrode members 21 and 21 is formed to extend in the cell extending direction of the honeycomb structure body 4. Further, in the honeycomb structure 100, each of the pair of electrode members 21 and 21 may be formed into a band-like shape "across both end portions" of the honeycomb structure body 4 in the cell extending direction. Thus, since the pair of electrode members 21 and 21 are arranged across both end portions of the honeycomb structure body 4, and hence, the deviation of the current flowing inside of the honeycomb structure body 4 can be further efficiently controlled when a voltage is applied between the pair of electrode members 21 and 21. Further, in the honeycomb structure 100 having this constitution, the deviation of the heat generation inside of the honeycomb structure body 4 can be further efficiently controlled. Here, when "the electrode member 21 is arranged across both end portions of the honeycomb structure body 4", the following state is meant. That is, it means that the one end portion of the electrode member 21 is in contact with the one end portion of the honeycomb structure body 4 while the other end portion of the electrode member 21 is in contact with the other end portion of the honeycomb structure body 4.

Figure 4:
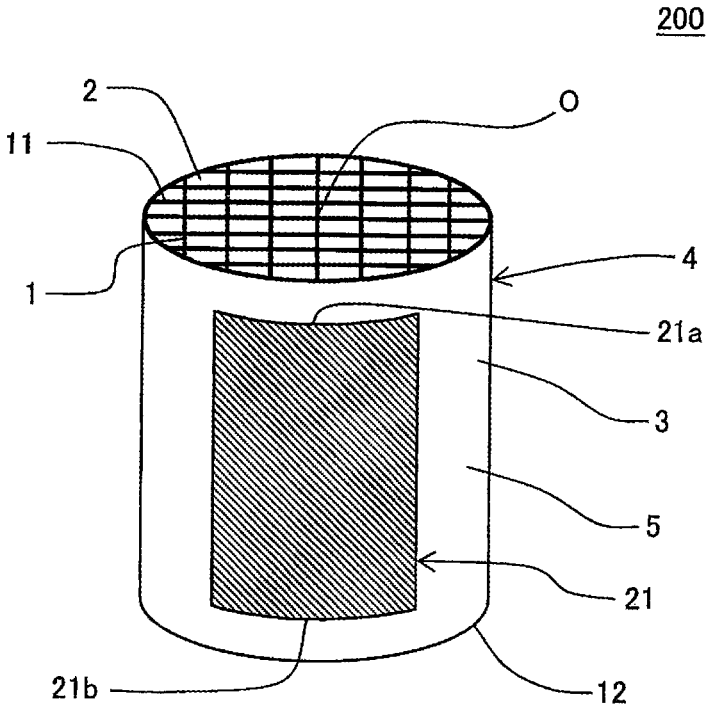
FIG. 4 is a perspective view schematically showing the honeycomb structure according to another embodiment of the present invention.
Figure 5:
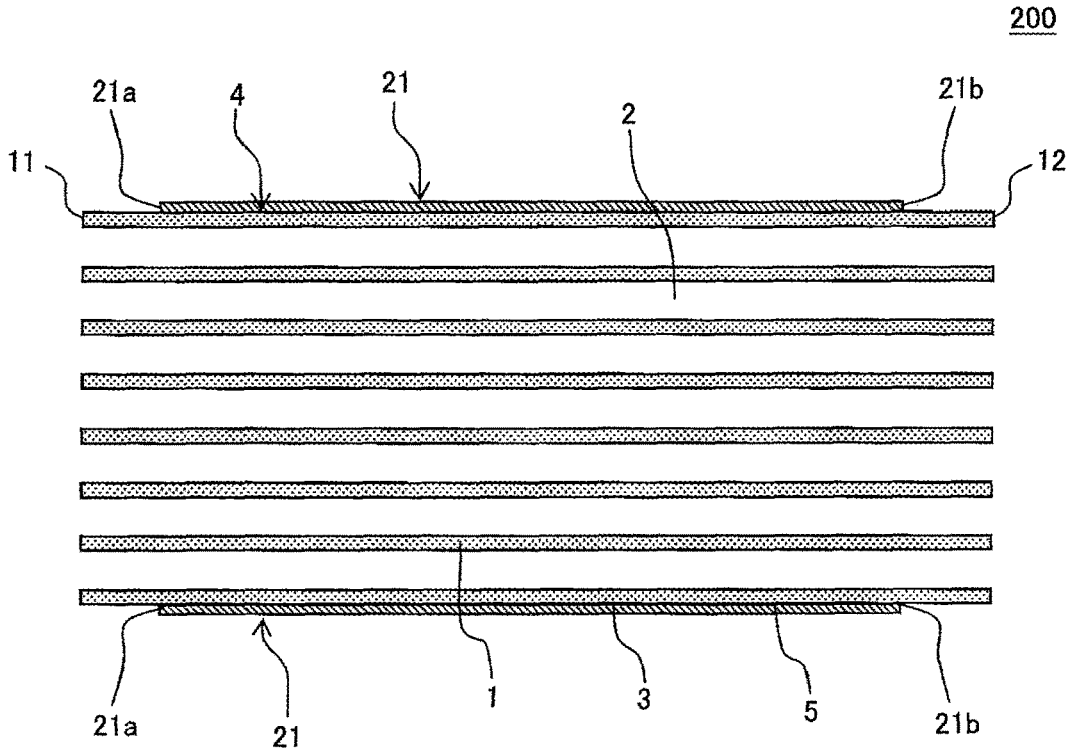
FIG. 5 is a schematic view showing a cross section which is parallel to a cell extending direction of the honeycomb structure according to another embodiment of the present invention.

Here, another configuration of the electrode member of the honeycomb structure of the present embodiment will be described. In the honeycomb structure of the present embodiment, it is also a preferable configuration that both end portions of the electrode member in "the cell extending direction of the honeycomb structure body" are not in contact with the first end face and the second end face of the honeycomb structure body. For example, as shown in FIG. 4 and FIG. 5, both end portions 21*a* and 21*b* of an electrode member 21 "in an extending direction of cells 2 of a honeycomb structure body 4" are not in contact with both end portions of the honeycomb structure body 4. It is to be noted that the above-mentioned "non-contact state" is a state where both the end portions 21*a* and 21*b* of the electrode member 21 do not reach a first end face 11 and a second end face 12 of the honeycomb structure body 4. FIG. 4 is a perspective view schematically showing the honeycomb structure according to another embodiment (a honeycomb structure 200) of the present invention. FIG. 5 is a schematic view showing a cross section which is parallel to the cell extending direction of the honeycomb structure according to another embodiment (the honeycomb structure 200) of the present invention. In the honeycomb structure 200 shown in FIG. 4 and FIG. 5, the same components as those of the honeycomb structure 100 shown in FIG. 1 to FIG. 3 are denoted with the same reference numerals and are not described. Furthermore, it is another preferable configuration that one end portion of the electrode member 21 is in contact with, for example, the first end face 11 of the honeycomb structure body 4, while the other end portion of the electrode member 21 is not in contact with the second end face 12 of the honeycomb structure body 4. Thus, in a state where at least one end portion of the electrode member 21 is not in contact with the first end face 11 or the second end face 12 of the honeycomb structure body 4, the thermal shock resistance of the honeycomb structure can be improved. That is, from the viewpoint that "improving the thermal shock resistance of the honeycomb structure", it is preferable that at least one end portion of each of the pair of electrode members 21 and 21 is not in contact with the first end face 11 or the second end face 12 of the honeycomb structure body 4. From the above, in a case where it is considered that the viewpoint of "the deviation of the current flowing inside of the honeycomb structure body 4 can be further efficiently controlled, and hence, the deviation of the heat generation inside of the honeycomb structure body 4 can be further efficiently controlled" is important, it is preferable that the pair of the electrode members 21 and 21 is arranged across both end portions of the honeycomb structure body 4. On the other hand, in a case where it is considered that the viewpoint of "improving the thermal shock resistance of the honeycomb structure" is important, it is preferable that at least one end portion of each of the pair of electrode members 21 and 21 does not reach the first end face 11 or the second end face 12 of the honeycomb structure body 4.

In the honeycomb structure 100 shown in FIG. 1 to FIG. 3, the electrode member 21 has a shape obtained as if by curving a flat surface-like rectangular member along an outer circumference of a round pillar-shaped honeycomb structure body 4. Here, the shape at a time when the curved electrode member 21 is deformed into a flat surface-like member which is not curved is referred to as "a planar shape" of the electrode member 21. "The planar shape" of the electrode member 21 shown in FIG. 1 to FIG. 3 is a rectangular shape. Further, "an outer circumferential shape of the electrode member" means "the outer circumferential shape in the planar shape of the electrode member".

As shown in FIG. 1 to FIG. 3, the outer circumferential shape of the band-like electrode member 21 may also have a rectangular shape. However, it is still another preferable configuration that the outer circumferential shape of the band-like electrode member 21 may also have "a rectangular shape whose corner portions are formed into a curved shape". Furthermore, it is a further preferable configuration that the outer circumferential shape of the band-like electrode member 21 may also have "a rectangular shape whose corner portions are linearly chamfered". A composite application of "a curved shape" and "a linear shape" is also preferable. The composite application of "the curved shape" and "the linear shape" means, for example, a shape in which at least one of the corner portions of the rectangular shape has "a curvedly formed shape" and at least one of the corner portions of the rectangular shape has "a linearly chamfered shape".

Thus, the outer circumferential shape of the electrode member 21 is "a rectangular shape whose corner portions are formed into a curved shape" or "a rectangular shape whose corner portions are linearly chamfered", and hence the thermal shock resistance of the honeycomb structure 100 can be further improved. When corner portions of the electrode member 21 are right-angled, there is the tendency that stress around "the corner portion of the electrode member 21" in the honeycomb structure body 4 is higher than that in another portion. On the other hand, when the corner portions of the electrode member 21 are formed into a curved shape or linearly chamfered, it is possible to decrease the stress around "the corner portion of the electrode member 21" in the honeycomb structure body 4.

As the honeycomb structure body 4 for use in the honeycomb structure 100 of the present embodiment, the honeycomb structure body 4 for use in a conventional honeycomb structure which functions as the heater when the voltage is applied thereto can be used. Hereinafter, a constitution of the honeycomb structure body 4 will be described, but the honeycomb structure 100 of the present embodiment is not limited to the honeycomb structure body 4 mentioned below.

In the honeycomb structure 100 of the present embodiment, the honeycomb structure body 4 is made of a material which includes a silicon carbide material. For example, a material of the partition walls 1 and the circumferential wall 3 of the honeycomb structure body 4 preferably includes a silicon-silicon carbide composite material or a silicon carbide material as a main component, and is further preferably the silicon-silicon carbide composite material or the silicon carbide material. When "the material of the partition walls 1 and the circumferential wall 3 includes silicon carbide particles and a silicon material as the main component", it is meant that the partition walls 1 and the circumferential wall 3 contain 90 mass % or more of silicon carbide particles and the silicon material in the whole material. When such a material is used, an electric resistivity of the honeycomb structure body 4 can be, for example, from 2 to 100 Ωcm. Here, the silicon-silicon carbide composite material contains the silicon carbide particles as aggregates, and silicon as a bonding material which bonds the silicon carbide particles, and the plurality of silicon carbide particles are preferably bonded by silicon so that pores are formed among the silicon carbide particles. Furthermore, in the silicon carbide material, the silicon carbide particles are mutually sintered. The electric resistivity of the honeycomb structure body 4 is a value at 25° C.

A porosity of the partition walls 1 of the honeycomb structure body 4 is preferably from 30 to 60% and further preferably from 35 to 45%. When the porosity is smaller than 30%, deformation during firing increases sometimes. When the porosity is in excess of 60%, strength of the honeycomb structure deteriorates sometimes. The porosity is a value measured with a mercury porosimeter.

An average pore diameter of the partition walls 1 of the honeycomb structure body 4 is preferably from 2 to 15 μm and further preferably from 5 to 12 μm. When the average pore diameter is smaller than 2 μm, the electric resistivity excessively increases sometimes. When the average pore diameter is larger than 15 μm, the electric resistivity excessively decreases sometimes. The average pore diameter is a value measured with the mercury porosimeter.

In the honeycomb structure body 4, a thickness of the partition walls 1 is preferably from 50 to 300 μm and further preferably from 100 to 200 μm. In such a range of the thickness of the partition walls 1, a pressure loss at flowing of an exhaust gas can be prevented from being excessively increased even in a case where the honeycomb structure 100 is used as the catalyst carrier to load a catalyst. When the thickness of the partition walls 1 is smaller than 50 μm, the strength of the honeycomb structure 100 deteriorates sometimes. When the thickness of the partition walls 1 is larger than 300 μm, a pressure loss at flowing of an exhaust gas excessively increases sometimes in a case where the honeycomb structure 100 is used as the catalyst carrier to load a catalyst.

A cell density of the honeycomb structure body 4 is preferably from 40 to 150 cells/cm$^2$ and further preferably from 70 to 100 cells/cm$^2$. In such a range of the cell density, a purification performance of the catalyst can be enhanced in a state where the pressure loss at the flowing of the exhaust gas is decreased. When the cell density is smaller than 40 cells/cm$^2$, a catalyst loading area may decrease. When the cell density is larger than 150 cells/cm$^2$, the pressure loss may increase in the case where the honeycomb structure 100 is employed as the catalyst carrier to load the catalyst and the exhaust gas is flown.

The electric resistivity of the honeycomb structure body 4 is preferably from 0.1 to 200 Ωcm and further preferably from 10 to 100 Ωcm. When the electric resistivity is smaller than 0.1 Ωcm, the current may excessively flow, for example, in a case where the honeycomb structure 100 is energized by a power source of a high voltage of 200 V or more. When the electric resistivity is larger than 200 Ωcm, the current does not easily flow and heat may be not sufficiently generated, for example, in the case where the honeycomb structure 100 is energized by the power source of the high voltage of 200 V or more. The electric resistivity of the honeycomb structure body 4 is a value measured by a four-terminal method.

The electric resistivity of the electrode member 21 is preferably lower than the electric resistivity of the honeycomb structure body 4, and furthermore, the electric resistivity of the electrode member 21 is further preferably 20% or less and especially preferably from 0.001 to 10% of the electric resistivity of the honeycomb structure body 4. When the electric resistivity of the electrode member 21 is 20% or less of the electric resistivity of the honeycomb structure body 4, the electrode member 21 further effectively functions as the electrode.

In a case where the material of the honeycomb structure body 4 is the silicon-silicon carbide composite material, it is preferable that the honeycomb structure body 4 is constituted as follows. A ratio of "the mass of silicon" contained in the honeycomb structure body 4 with respect to the sum of "the mass of the silicon carbide particles" contained in the honeycomb structure body 4 and "the mass of silicon" contained in the honeycomb structure body 4 is preferably from 10 to 40 mass % and further preferably from 15 to 35 mass %. When this ratio is smaller than 10 mass %, the strength of the honeycomb structure may be degraded. When the ratio is larger than 40 mass %, the shape cannot possibly be held at firing.

In the honeycomb structure body, it is more preferable that the porosity is from 30 to 60%, the average pore diameter is from 2 to 15 μm, the thickness of the partition walls is from 50 to 300 μm, the cell density is from 40 to 150 cells/cm$^2$, and the electric resistivity between the pair of electrode members is from 0.1 to 100Ω. The honeycomb structure body having this constitution is the catalyst carrier and also functions as the heater when the voltage is applied thereto. When the electric resistivity between the pair of electrode members is from 0.1 to 100Ω and the voltage is applied to the honeycomb structure body 4, the honeycomb structure body 4 suitably generates heat. Especially, also when the honeycomb structure body 4 is energized by the power source of the high voltage, the current may not excessively flow and the honeycomb structure is suitably used as the heater.

Furthermore, a thickness of the circumferential wall 3 constituting the outermost circumference of the honeycomb structure body 4 is preferably from 0.1 to 2 mm. When the thickness is smaller than 0.1 mm, a strength of the honeycomb structure 100 may degrade. When the thickness is thicker than 2 mm, an area of the partition walls 1 onto which a catalyst is loaded may decrease.

In the honeycomb structure body 4, a shape of the cells 2 in the cross section perpendicular to the extending direction of the cells 2 is preferably a quadrangular shape, a hexagonal shape, an octagonal shape, or a combination of these shapes. The shape of the cells 2 is preferably a square shape or a hexagonal shape. With such a cell shape, the pressure loss at the flowing of the exhaust gas through the honeycomb structure 100 decreases, achieving an excellent purification performance of the catalyst.

There is not any special restriction on a whole shape of the honeycomb structure body 4. Examples of a shape can include a pillar shape with a round end face, a pillar shape with an oval end face and a pillar shape with a polygonal end face such as a quadrangular shape, a pentangular shape, a hexagonal shape, a heptagonal shape or an octagonal shape, or a similar shape. Moreover, as to a size of the honeycomb structure body 4, an area of the end face is preferably from 2000 to 20000 mm$^2$ and further preferably from 4000 to 10000 mm$^2$. Furthermore, a length of the honeycomb structure body 4 in a central axis direction is preferably from 50 to 200 mm, and further preferably from 75 to 150 mm.

The honeycomb structure 100 of the present embodiment is preferably used as a catalyst carrier, in which the catalyst be loaded.

Figure 6:
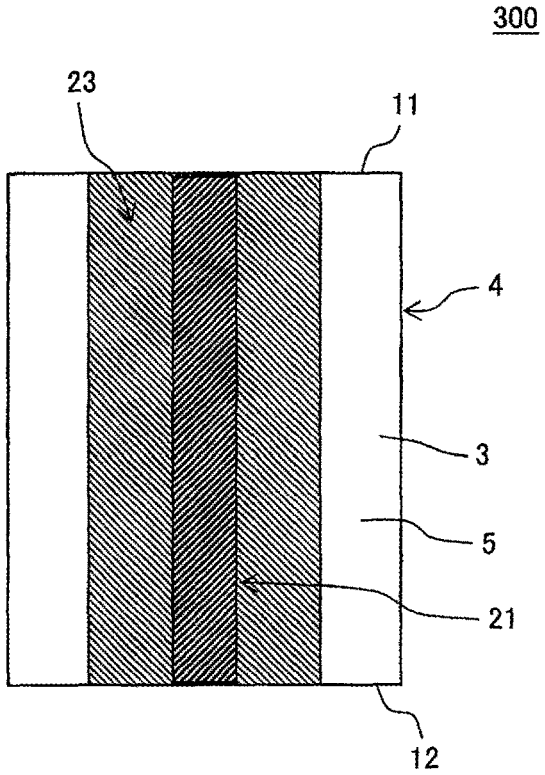
FIG. 6 is a front view schematically showing the honeycomb structure according to still another embodiment of the present invention.

Next, a honeycomb structure according to still another embodiment of the present invention will be described. The honeycomb structure of the present embodiment is such a honeycomb structure 300 as shown in FIG. 6. The honeycomb structure 300 is the honeycomb structure that a conductive intermediate layer 23 made of a material which includes at least one of a silicon carbide material and metal silicon is disposed between the side face 5 of the honeycomb structure body 4 and the electrode member 21 in the honeycomb structure 100 shown in FIG. 1 to FIG. 3. That is, as shown in FIG. 6, in the honeycomb structure 300, a conductive intermediate layer 23 is first disposed on a side face 5 of a honeycomb structure body 4, and furthermore, an electrode member 21 is disposed on the surface of the conductive intermediate layer 23. At least a part of the pair of electrode members 21 and 21 in the honeycomb structure 300 is made of the hitherto described "specific composite material". FIG. 6 is a front view schematically showing still another embodiment of the honeycomb structure of the present invention. The honeycomb structure 300 is preferably constituted similarly to the honeycomb structure 100 shown in FIG. 1 to FIG. 3 except that the conductive intermediate layer 23 is disposed between the side face 5 of the honeycomb structure body 4 and the electrode member 21.

The conductive intermediate layer 23 is made of a material which includes at least one of a silicon carbide material and a metal silicon, and has, for example, a function of protecting the honeycomb structure body 4 so that the honeycomb structure body 4 is not damaged when forming the electrode member 21. Furthermore, the conductive intermediate layer 23 also has a function of uniformly flowing a current through the whole honeycomb structure body 4. For example, when the conductive intermediate layer 23 expands in wider area than the electrode member 21, the current is supplied to a wider area of the side face 5 of the honeycomb structure body 4, and which enables the current to more uniformly flow.

As shown in FIG. 6, the conductive intermediate layer 23 is preferably disposed under a wider area than "the area where the electrode member 21 is disposed" in the side face 5 of the honeycomb structure body 4. In FIG. 6, the conductive intermediate layer 23 is disposed under a wider area than the area of the electrode member 21 in a peripheral direction of the honeycomb structure body 4. According to such a constitution, it is possible to effectively protect the honeycomb structure body 4 so that the honeycomb structure body 4 is not damaged when the electrode member 21 is formed. Furthermore, a current can uniformly flow through the honeycomb structure body 4. A length of the conductive intermediate layer 23 is preferably equal to a length of the electrode member 21 or preferably longer than the length of the electrode member 21. FIG. 6 shows an example where the length of the conductive intermediate layer 23 is equal to the length of the electrode member 21. The length of the conductive intermediate layer 23 and the length of the electrode member 21 are lengths in an extending direction of "cells of the honeycomb structure body".

The length of the conductive intermediate layer 23 in the peripheral direction may be equal to or longer than the length of the electrode member 21 in the peripheral direction. Here, "the peripheral direction" means the peripheral direction in the outer circumference of the honeycomb structure body. The length of the conductive intermediate layer 23 in the peripheral direction is 100% or more of the length of the electrode member 21 in the peripheral direction, and "0.5 times of a central angle $\alpha$ of each electrode member (i.e., an angle $\theta$ of 0.5 times of the central angle $\alpha$)" is preferably from 10 to 65° and further preferably from 30 to 60°. When the conductive intermediate layer and the electrode member lengthen as much as the above-mentioned "angle $\theta$" or more, the current easily flows in a circumferential direction and an energization distribution may deteriorate.

Furthermore, a thickness of the conductive intermediate layer 23 is preferably from 50 to 500 μm. When the thickness is smaller than 50 μm, a function of protecting the honeycomb structure body 4 may not sufficiently develop. On the other hand, when the thickness is larger than 500 μm, the conductive intermediate layer is easily cracked, and thermal shock resistance may deteriorate.

Figure 7:
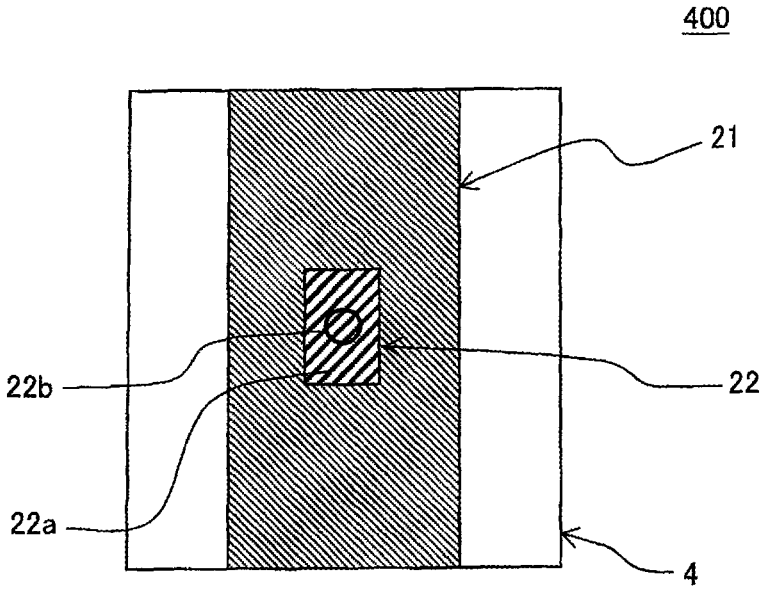
FIG. 7 is a front view schematically showing the honeycomb structure according to still another embodiment of the present invention.

Next, a further embodiment of the honeycomb structure of the present invention will be described. The honeycomb structure of the present embodiment is such a honeycomb structure 400 as shown in FIG. 7. The honeycomb structure 400 is the honeycomb structure that an electrode terminal projecting portion to be connected to an electric wire is disposed on the surface of each of the electrode members 21 and 21 in the honeycomb structure 100 shown in FIG. 1 to FIG. 3. That is, as shown in FIG. 7, an electrode terminal projecting portion 22 can be disposed in the vicinity of a center of the surface of each of electrode members 21 and 21. Thus, when the electrode terminal projecting portion 22 is disposed in this manner, the wire from a power source can easily be connected, and when a voltage is applied to each of the electrode members 21 and 21, a deviation of a temperature distribution of a honeycomb structure body 4 can be further decreased. FIG. 7 is a front view schematically showing the honeycomb structure according to still another embodiment of the present invention.

The honeycomb structure 400 of the present embodiment is preferably constituted similarly to the honeycomb structure 100 shown in FIG. 1 to FIG. 3 except that the electrode terminal projecting portion 22 is disposed in each of the electrode members 21 and 21.

There is not any special restriction on a shape of the electrode terminal projecting portion 22 as long as the electrode terminal projecting portion can be bonded to the electrode member 21 and can be connected to the electric wire. For example, as shown in FIG. 7, the electrode terminal projecting portion 22 preferably has a shape in which a round pillar-shaped projecting portion 22*b* is disposed on a quadrangular plate-shaped substrate 22*a*. Such a shape enables the electrode terminal projecting portion 22 to firmly be bonded to the electrode member 21 via the substrate 22*a*, and the projecting portion 22*b* enables the electric wire to securely be connected to.

In the honeycomb structure 400, the electrode terminal projecting portion 22 may be made of the hitherto described specific composite material. For example, the substrate 22*a* which is comprised the electrode terminal projecting portion 22 may be made of the hitherto described specific composite material. According to this constitution, the electrode terminal projecting portion 22 excellent in oxidation resistance to a thermal load can be formed. Needless to say, a pair of electrode members 21 and 21 may be made of the hitherto described specific composite material.

A thickness of the substrate 22*a* in the electrode terminal projecting portion 22 is preferably from 0.05 to 2 mm. This range of the thickness enables the electrode terminal projecting portion 22 to securely be bonded to the electrode member 21. When the thickness is smaller than 0.05 mm, the substrate 22*a* weakens and the projecting portion 22*b* may easily drop from the substrate 22*a*. When the thickness is larger than 2 mm, a space in which the honeycomb structure is disposed may increase more than necessary.

(2) Manufacturing Method of Honeycomb Structure:

Next, an embodiment of a manufacturing method of the honeycomb structure of the present invention will be described. The manufacturing method of the honeycomb structure according to the present embodiment includes a step of forming a pair of electrode members. Hereinafter, the step of forming the pair of electrode members is referred to as "an electrode member forming step". In the electrode member forming step, an electrode member forming raw material is first prepared to form the pair of electrode members.

Furthermore, in the electrode member forming step, "a pillar-shaped honeycomb formed body" is prepared. The pillar-shaped honeycomb formed body becomes the honeycomb structure body in the honeycomb structure of a manufacturing target. It is to be noted that in the electrode member forming step, "a honeycomb fired body" prepared by firing the honeycomb formed body may be used.

Next, an electrode member forming raw material is thermally sprayed or applied to the side of a side face of the prepared "pillar-shaped honeycomb formed body" or "honeycomb fired body" to form the electrode member of the honeycomb structure. In the manufacturing method of the honeycomb structure of the present embodiment, as the electrode member forming raw material, a mixture which includes solid-like silicon and powder of at least one of a metal boride and a boride is used. Further, in the manufacturing method of the honeycomb structure of the present embodiment, the mixture prepared as the electrode member forming raw material is thermally sprayed or the applied mixture is heated at a temperature of 1400° C. or more to melt silicon in the mixture, thereby to form the electrode member. That is, the above mixture is thermally sprayed to form the electrode member. Alternatively, the applied mixture is heated at the temperature of 1400° C. or more to melt silicon in the heated mixture, thereby to form the electrode member. When the electrode member forming step is performed by this method, the honeycomb structure 100 as hitherto described and shown in FIG. 1 to FIG. 3 can be easily manufactured. That is, in a case of thermally spraying the mixture to form the electrode member, when the thermal spraying is performed, a silicon in the mixture is doped with a boron element from the metal boride and the boride, so that silicon which includes 100 to 10000 ppm of boron can be easily generated. Furthermore, also in a case of melting silicon in the mixture to form the electrode member, silicon in the mixture is doped with the boron element from the metal boride and boride, and a silicon which includes 100 to 10000 ppm of boron can easily be generated.

There is not any special restriction on a purity of "solid-like silicon" for use as the electrode member forming raw material, and, for example, an impurity element concentration is preferably 100 ppm or less and the purity is 99.99% or more.

As the metal boride, at least one selected from the group consisting of CrB, $CrB_2$, $ZrB_2$, $TaB_2$, $NbB_2$, WB, and MoB can be used. For example, "CrB" has a low electric resistivity of about 45 μΩm, and in the electrode members made of the specific composite material which includes CrB, an initial electric resistivity decreases as compared with the electrode members which includes another component. Consequently, for example, in the electrode members made of the specific composite material which includes CrB, even when CrB in the specific composite material oxidizes, an effect of preventing the increase of the electric resistivity of the electrode members can be easily obtained. Another metal boride can be also suitably used as a raw material to dope silicon in the mixture with the boron element.

As the boride, at least one of BN and $B_4C$ can be used. Such a boride can be also suitably used as the raw material to dope silicon in the mixture with the boron element.

In the electrode member forming raw material, a volume ratio of solid-like silicon is preferably 70 volume % or more, further preferably from 80 to 98 volume %, and especially preferably from 80 to 92 volume % with respect to a total volume of respective raw materials for use in the electrode member forming raw material.

There is not any special restriction on a method of thermally spraying the electrode member forming raw material to the side of the side face of the honeycomb formed body or the honeycomb fired body, and a known thermal spraying method can be used. It is to be noted that when the thermally spraying of the electrode member forming raw material is performed, a shielding gas of argon or the like may simultaneously be passed for the purpose of inhibiting an oxidation of metal silicon. Furthermore, an example of a method of applying the electrode member forming raw material to the side of the side face of the honeycomb formed body or the honeycomb fired body is a method of preparing the electrode member forming raw material in the form of paste and directly applying the electrode member forming raw material with a brush or by any type of printing method.

Before thermally spraying the electrode member forming raw material to the side of the side face of the honeycomb formed body, a conductive raw material which includes at least one of silicon carbide and metal silicon may be applied to the side face of the honeycomb formed body, followed by drying or baking, to form a conductive intermediate layer. Further, the electrode member forming raw material is preferably thermally sprayed to the surface of the formed conductive intermediate layer to form the electrode member. According to this constitution, the honeycomb formed body from is effectively prevented from being damaged. Furthermore, a step of applying the conductive raw material to form the conductive intermediate layer may be performed to the honeycomb fired body obtained by firing the honeycomb formed body. Further, the electrode member forming raw material may be thermally sprayed to the surface of the conductive intermediate layer formed on the side face of the honeycomb formed body to form the electrode member made of the electrode member forming raw material. Furthermore, also when the electrode member forming raw material is applied to form the electrode member, the conductive intermediate layer may be formed by the above-mentioned method.

A step of heating the mixture prepared as the electrode member forming raw material at a temperature of 1400° C. or more can be performed, for example, as follows. It is to be noted that in the following description, the description will be made as to an example of applying the electrode member forming raw material to the side of the side face of a honeycomb dried body. The electrode member forming raw material applied to the side of the side face of the honeycomb dried body is preferably dried to prepare "the honeycomb dried body with the electrode member forming raw material". Drying conditions are preferably set at 100 to 130° C. Next, for the purpose of removing a binder and the like included in the electrode member forming raw material applied to honeycomb dried body and the side of the side face of the honeycomb dried body, degreasing is preferably performed. Degreasing is preferably performed at 400 to 550° C. in the air atmosphere for 0.5 to 20 hours. Next, the honeycomb dried body with the electrode member forming raw material is preferably fired to prepare the honeycomb structure. On firing conditions, heating is preferably performed at 1400 to 1500° C. in an inert atmosphere of argon or the like for 1 to 20 hours. The temperature of the firing conditions in the present specification is a temperature of a firing atmosphere.

As solid-like silicon which is used as the electrode member forming raw material, a powder having an average particle diameter of 5 to 100 μm is preferably used. Using a silicon powder in which the average particle diameter is in the above numeric range enables a fluidity to become suitable in a supply path to a thermal spraying gun in the thermal spraying step and a supply rate to be stably kept to be constant. It is to be noted that when the average particle diameter of silicon is excessively small, the fluidity of the electrode member forming raw material may deteriorate. Furthermore, when the average particle diameter of silicon is excessively large, silicon may be hard to melt.

As the metal boride and boride which is used as the electrode member forming raw material, a powder having an average particle diameter of 100 μm or less is preferably used. When the average particle diameter of the metal boride and boride is in excess of 100 μm, the electrode member forming raw material may be hard to melt.

Hereinafter, the manufacturing method of the honeycomb structure of the present embodiment will be described in more detail with reference to an example of the method of manufacturing the honeycomb structure shown in FIG. 1 to FIG. 3.

First, the honeycomb formed body is prepared by the following method. The silicon powder (silicon), the binder, a surfactant, a pore former, water and the like are added to the silicon carbide powder (silicon carbide) to prepare a honeycomb forming raw material. A mass of the silicon powder into 10 to 40 mass % with respect to the sum of the mass of the silicon carbide powder and the mass of the silicon powder. The average particle diameter of the silicon carbide particles in the silicon carbide powder is preferably from 3 to 50 μm and further preferably from 3 to 40 μm. An average particle diameter of silicon particles (the silicon powder) is preferably from 1 to 35 μm. The average particle diameters of the silicon carbide particles and silicon particles are values measured by a laser diffraction method. The silicon carbide particles are particulates of silicon carbide which is comprised the silicon carbide powder and the silicon particles are particulates of silicon which is comprised the silicon powder. It is to be noted that this is a blend of the honeycomb forming raw material in a case where the material of the honeycomb structure body is a silicon-silicon carbide based composite material, and silicon is not added in a case where the material of the honeycomb structure body is silicon carbide.

As to the binder, the surfactant, the pore former and the like, those which are used in a heretofore known honeycomb structure manufacturing method can be used. Furthermore, amounts of the binder, the surfactant, the pore former, the water and the like to be used can suitably be selected in conformity with the heretofore known manufacturing method of the honeycomb structure.

Next, the honeycomb forming raw material is kneaded to form a kneaded material. There is not any special restriction on a method of kneading the honeycomb forming raw material to form the kneaded material, and an example of the method is a method of using a kneader, a vacuum pugmill or the like.

Next, the kneaded material is extruded to prepare the honeycomb formed body. During the extrusion, a die having a desirable whole shape, cell shape, partition wall thickness, cell density and the like is preferably used. As a material of the die, a cemented carbide which is hard to be worn is preferably used. The honeycomb formed body is a structure having partition walls which define a plurality of cells which become through channels for a fluid and a circumferential wall positioned at an outermost circumference.

The partition wall thickness, cell density, circumferential wall thickness and the like of the honeycomb formed body can suitably be determined in consideration of shrinkage in drying and firing and in accordance with a structure of the honeycomb structure of the present invention which is to be prepared.

Next, the obtained honeycomb formed body is preferably dried. The dried honeycomb formed body will be referred to as "the honeycomb dried body" sometimes. There is not any special restriction on a drying method, and a heretofore known drying method can be employed.

In the manufacturing method of the honeycomb structure of the present embodiment, the honeycomb dried body obtained in this manner may be degreased and then fired to prepare the honeycomb fired body. In the manufacturing method of the honeycomb structure of the present embodiment, the hitherto described electrode member forming step is performed to the honeycomb dried body or the honeycomb fired body to form the electrode members.

Next, in a case where the electrode member forming step is performed to the honeycomb dried body, the honeycomb dried body is fired to prepare the honeycomb structure. In a case where the electrode member forming step is performed to the honeycomb fired body, the honeycomb structure of the manufacturing target is obtained after the electrode member forming step.

On firing conditions when the honeycomb dried body is fired, heating is preferably performed at 1400 to 1500° C. in the inert atmosphere of argon or the like for 1 to 20 hours. The temperature of the firing conditions in the present specification is the temperature of the firing atmosphere.

Furthermore, after the firing, an oxidation treatment at 1000 to 1350° C. for 1 to 10 hours is preferably performed for the purpose of improvement of durability. The oxidation treatment means a heating treatment in an oxidation atmosphere. As described above, the honeycomb structure 100 shown in FIG. 1 to FIG. 3 can be manufactured.

EXAMPLES

Hereinafter, the present invention will further specifically be described with reference to examples, however, the present invention is not limited to these examples.

Example 1

950 g of silicon powder and 50 g of CrB powder were mixed to prepare an electrode member forming raw material. The above powder mixing was performed with a mixing bag or a vertical stirrer. The silicon powder had a purity of 99.99%. The silicon powder had an average particle diameter of 60 μm. The CrB powder had an average particle diameter of 50 μm. The average particle diameter is a value measured by a laser diffraction method.

The electrode member forming raw material obtained in this manner was thermally sprayed to a side face of a honeycomb fired body prepared by the following method to prepare an electrode member. Additionally, in Example 1, before the electrode member forming raw material is thermally sprayed, a conductive raw material containing silicon carbide and metal silicon was applied to an area of the honeycomb fired body to which the electrode member forming raw material was thermally sprayed, and the applied conductive raw material was dried and fired to form a conductive intermediate layer on the side face of the honeycomb fired body. Further, the electrode member forming raw material was thermally sprayed to the surface of the formed conductive intermediate layer to prepare the electrode member. The thermal spraying of the electrode member forming raw material was a plasma thermal spraying on such thermal spraying conditions as described below. As a plasma gas, an Ar—$H_2$ mixed gas made of 30 L/min of an Ar gas and 10 L/min of an $H_2$ gas was used. Further, a plasma current was set to 600 A, a plasma voltage was set to 60 V, a thermal spraying distance was set to 150 mm, and an amount of thermally spraying particles to be supplied was set to 30 g/min. Further, to inhibit an oxidation of a metal phase during the thermal spraying, a plasma frame was shielded with the Ar gas. In the thermal spraying of the electrode member forming raw material, the raw material was thermally sprayed mainly to the honeycomb fired body.

For the honeycomb fired body, a honeycomb formed body was prepared by the following method. First, a honeycomb forming raw material to prepare the honeycomb formed body was prepared. The honeycomb forming raw material was prepared by mixing 6 kg of 5 μm metal silicon powder, 14 kg of 30 μm silicon carbide powder, 1 kg of cordierite powder, 1.6 kg of methylcellulose, and 8 kg of water, followed by kneading with a kneader.

Next, the obtained honeycomb forming raw material was vacuum-kneaded to obtain a kneaded material and the obtained kneaded material was extruded in the form of a honeycomb, thereby to obtain the honeycomb formed body. A honeycomb dried body was fired and oxidization-treated to prepare the honeycomb fired body. The firing was performed at 1450° C. in an argon atmosphere for 2 hours. The oxidation treatment was performed at 1300° C. in the air for 1 hour.

The obtained honeycomb fired body had a partition wall thickness of 101.6 μm and a cell density of 93 cells/$cm^2$. Furthermore, a diameter of an end face of the honeycomb fired body was 100 mm and a length in a cell extending direction was 100 mm. On the side of a side face of the honeycomb fired body obtained in this manner, the electrode members were formed by thermally spraying the electrode member forming raw material as described above, thereby to manufacture a honeycomb structure of Example 1. The electrode member was made of a composite material which contains silicon as a main component and further contains CrB.

As to the electrode members of the honeycomb structure of Example 1, a composition of the composite material which is comprised the electrode members was confirmed by the following method. As the composition of the composite material, "the main component", "an amount (volume %) of Si", "an amount (ppm) of B to be doped" and "another component" were measured. Table 1 shows the results. It is to be noted that "the amount (ppm) of B to be doped" is an amount of boron included in silicon.

a case where carbon and boron were detected, the position was defined as "$B_4C$". Next, with the scanning electron microscope, an observation was performed so that the respective components which were defined in the EPMA analysis were shaded. Further, from observation results of 6 viewing fields at a magnification of 200 times, a ratio of each component was measured by an image processing software, and occupying ratios (area %) of silicon and the other components in the image were obtained to define the value as a ratio of a volume (volume %) of each component. "The ratio of the volume of silicon" obtained in this manner was defined as "the amount (volume %) of Si". As the image processing software, "ImagePro (trade name)" manufactured by Nihon Visual Science, Inc. was used.

TABLE 1

| | Composition of composite material | | | | | Electric resistivity | Electric resistivity of electrode | Thermal expansion | |
|---|---|---|---|---|---|---|---|---|---|
| | B source | Main component | Si amount (volume %) | Amount of B to be doped (ppm) | Another component | of electrode member (Ωcm) | member after heat treatment (Ωcm) | coefficient of electrode member $\times 10^{-6}$ (/K) | Energization durability test |
| Example 1 | CrB | Si | 98.0 | 215 | CrB | 0.090 | 0.082 | 4.0 | OK |
| Example 2 | CrB | Si | 91.3 | 1240 | CrB | 0.014 | 0.050 | 4.5 | OK |
| Example 3 | CrB | Si | 72.5 | 4280 | CrB | 0.004 | 0.041 | 6.1 | OK |
| Comparative Example 1 | CrB | Si | 39.7 | 10070 | CrB | 0.001 | 0.053 | 8.9 | NG |
| Example 4 | $CrB_2$ | Si | 91.3 | 1730 | $CrB_2$ | 0.010 | 0.055 | 4.4 | OK |
| Example 5 | $CrB_2$ | Si | 72.5 | 5700 | $CrB_2$ | 0.003 | 0.042 | 5.6 | OK |
| Example 6 | $ZrB_2$ | Si | 91.3 | 300 | $ZrB_2$ | 0.062 | 0.053 | 4.0 | OK |
| Example 7 | $ZrB_2$ | Si | 83.0 | 400 | $ZrB_2$ | 0.055 | 0.051 | 4.1 | OK |
| Example 8 | $ZrB_2$ | Si | 72.5 | 875 | $ZrB_2$ | 0.020 | 0.050 | 4.4 | OK |
| Example 9 | BN | Si | 91.3 | 270 | BN | 0.070 | 0.090 | 3.6 | OK |
| Example 10 | BN | Si | 72.5 | 510 | BN | 0.035 | 0.075 | 3.0 | OK |
| Comparative Example 2 | BN | Si | 39.7 | 1730 | BN | 0.010 | 0.100 | 2.1 | NG |
| Example 11 | $B_4C$ | Si | 98.0 | 3430 | $B_4C$ | 0.005 | 0.006 | 3.8 | OK |
| Example 12 | $B_4C$ | Si | 91.3 | 5690 | $B_4C$ | 0.003 | 0.008 | 3.9 | OK |
| Example 13 | $B_4C$ | Si | 72.5 | 6830 | $B_4C$ | 0.002 | 0.007 | 4.1 | OK |
| Comparative Example 3 | None | NiCr | — | — | None | 0.004 | 0.110 | 9.6 | NG |
| Comparative Example 4 | None | Si | 100 | 30 | None | 3.2 | 1.2 | 3.8 | NG |
| Example 14 | CrB | Si | 91.3 | 1245 | CrB | 0.010 | 0.045 | 4.5 | OK |
| Example 15 | CrB | Si | 91.3 | 1240 | CrB | 0.012 | 0.050 | 4.5 | OK |

Main Component, Amount (Volume %) of Si, and Another Component

A cross section of an electrode member of the honeycomb structure was imaged with a scanning electron microscope, and from an image obtained by the imaging, a main component of a composite material which is comprised the electrode member and an amount (volume %) of Si were measured. Specifically, the electrode member was first cut to expose a cross section of the electrode member. Next, unevenness of the cross section of the electrode member was filled with a resin, and furthermore, the surface filled with the resin was polished. Next, the polished surface of the electrode member was observed, and an elementary analysis of the material which is comprised the electrode member was performed by EPMA analysis. In the EPMA analysis, a position at which a silicon element was only detected or silicon and boron were detected was defined as "silicon". In the EPMA analysis, a position at which chromium and boron were detected at a ratio of 1:1 was defined as "CrB" and a position at which chromium and boron were detected at a ratio of 1:2 was defined as "$CrB_2$".

Furthermore, in a case where nitrogen and boron were detected, the position was defined as "BN". Furthermore, in Amount (ppm) of B to be Doped The electrode member which includes the position defined as "silicon" by EDX analysis of the electrode member was cut into about several millimeters, and a cross section of the cut electrode member was prepared by using BIB method, thereby to prepare a sample to measure the amount of B to be doped (i.e., the amount of boron). Next, as to the sample whose cross section was prepared, boron in silicon was analyzed by time-of-flight secondary mass spectrometry. Further, the amount (ppm) of B to be doped was obtained by conversion from a correlation between spectral intensity and concentration of B in Si.

Furthermore, as to the obtained honeycomb structure, an electric resistivity of the electrode member, an electric resistivity of the electrode member after a heat treatment and a thermal expansion coefficient of the electrode member were measured by the following methods. Table 1 shows the result. Furthermore, as to the obtained honeycomb structure, an energization durability test was carried out by the following method. Table 1 shows the result.

Electric Resistivity (Ωcm) of Electrode Member

In the measurement of the electric resistivity of the electrode member, first, a measurement sample to measure the electric resistivity was cut out and prepared from the electrode member of the honeycomb structure prepared in each of examples and comparative examples. A size of the measurement sample was set to a longitudinal size of 0.2 mm×a lateral size of 4 mm×a length of 40 mm. As to the prepared measurement sample, the whole surfaces of both end portions were coated with a silver paste and wired to enable an energization. The measurement sample was connected to a voltage applying current measuring device to apply a voltage. A voltage of 10 to 200 V was applied, and a current value and a voltage value were measured in a state at 25° C., and from the obtained current value and voltage value, and a dimension of a test piece, the electric resistivity (Ωcm) was calculated.

Electric Resistivity (Ωcm) of Electrode Member after Heat Treatment

The honeycomb structure prepared in each of the examples and comparative examples was thrown into an electric furnace having an in-furnace temperature of 1000° C. The atmosphere in the electric furnace was the air atmosphere. In this state, the honeycomb structure was held for 72 hours and then the honeycomb structure was removed from the electric furnace. The honeycomb structure was cooled down to 25° C. and then the electric resistivity (0 cm) of the electrode member was measured by a method similar to the method described above in (the electric resistivity (Ωcm) of the electrode member).

Thermal Expansion Coefficient ($\times 10^{-6}$ (/K)) of Electrode Member

In the measurement of the thermal expansion coefficient of the electrode member, a measurement sample to measure the thermal expansion coefficient was cut out and prepared from the electrode member of the honeycomb structure prepared in each of the examples and comparative examples. A size of the measurement sample was set to a longitudinal size of 0.2 mm×a lateral size of 4 mm×a length of 50 mm. As to the prepared measurement sample, the thermal expansion coefficient was measured by using "TD5000S (trade name)" manufactured by Bruker AXS K.K. The measured value was defined as the thermal expansion coefficient ($\times 10^{-6}$ (/K)) of the electrode member.

Energization Durability Test

An energization durability test was carried out by the following method. First, the honeycomb structure prepared in each of the examples and comparative examples was connected to a power source and an energization test was carried out so that a quantity of heat to be input was 100 KJ. Further, the honeycomb structure which generated heat due to the energization was cooled and then the energization was carried out again. Such energization and cooling to the honeycomb structure were defined as one cycle. Further, the cycles were repeated until an abnormality occurred in the electrode members or until fusing of a metal which is comprised the electrode members occurred. Additionally, in the energization durability test, 2000 cycles were defined as an upper limit, and in a case where 2000 cycles were carried out, presence/absence of abnormal heat generation of the electrode members was confirmed at the end of the 2000 cycles. Increase of resistance due to an oxidation of the electrode members caused the abnormal heat generation of the electrode members and the fusing of the metal electrodes. In the energization durability test, evaluation was performed in accordance with the following evaluation standard. An example where there were not any abnormalities of the electrode members in the energization durability test of 2000 cycles was evaluated as "OK". An example where the abnormal heat generation of the electrode members or the fusing of the metal electrodes occurred in the energization durability test smaller than 2000 cycles or the energization durability test of 2000 cycles was evaluated as "NG".

Examples 2 and 3

In Example 2, a honeycomb structure was prepared by a method similar to Example 1, except that 800 g of silicon powder and 200 g of CrB powder were used. In Example 3, a honeycomb structure was prepared by a method similar to Example 1, except that 500 g of silicon powder and 500 g of CrB powder were used.

Examples 4 and 5

In Example 4, an electrode member forming raw material was prepared by using 820 g of silicon powder and 190 g of $CrB_2$ powder. In Example 5, an electrode member forming raw material was prepared by using 520 g of silicon powder and 480 g of $CrB_2$ powder. A honeycomb structure was prepared by a method similar to Example 1, except that the electrode member forming raw materials were prepared as described above.

Examples 6 to 8

In Example 6, an electrode member forming raw material was prepared by using 800 g of silicon powder and 200 g of $ZrB_2$ powder. In Example 7, an electrode member forming raw material was prepared by using 650 g of silicon powder and 350 g of $ZrB_2$ powder. In Example 8, an electrode member forming raw material was prepared by using 500 g of silicon powder and 500 g of $ZrB_2$ powder. A honeycomb structure was prepared by a method similar to Example 1, except that the electrode member forming raw materials were prepared as described above.

Examples 9 and 10

In Example 9, an electrode member forming raw material was prepared by using 875 g of silicon powder and 125 g of BN powder. In Example 10, an electrode member forming raw material was prepared by using 635 g of silicon powder and 365 g of BN powder. A honeycomb structure was prepared by a method similar to Example 1, except that the electrode member forming raw materials were prepared as described above.

Examples 11 to 13

In Example 11, an electrode member forming raw material was prepared by using 980 g of silicon powder and 20 g of $B_4C$ powder. In Example 12, an electrode member forming raw material was prepared by using 905 g of silicon powder and 95 g of $B_4C$ powder. In Example 13, an electrode member forming raw material was prepared by using 710 g of silicon powder and 290 g of $B_4C$ powder. A honeycomb structure was prepared by a method similar to Example 1, except that the electrode member forming raw materials were prepared as described above.

Comparative Examples 1 to 4

In Comparative Example 1, a honeycomb structure was prepared by a method similar to Example 1, except that 200 g of silicon powder and 800 g of CrB powder were used. In Comparative Example 2, a honeycomb structure was prepared by a method similar to Example 8, except that 305 g of silicon powder and 695 g of BN powder were used. In Comparative Example 3, an electrode member forming raw material was prepared only by using NiCr powder, to form electrode members. In Comparative Example 4, an electrode member forming raw material was prepared only by using silicon powder, to form electrode members.

Example 14

In Example 14, a honeycomb structure was prepared by a method similar to Example 1, except that a honeycomb fired body prepared by such a method as described below was used. A binder, a surfactant and water were added to silicon carbide (powder) and kneaded with a kneader to prepare a honeycomb forming raw material. Next, the obtained honeycomb forming raw material was kneaded with a vacuum pugmill to obtain a kneaded material, and the obtained kneaded material was extruded in the form of a honeycomb to obtain a honeycomb formed body. A honeycomb dried body was degreased and fired at 2200° C. in an argon atmosphere to prepare the honeycomb fired body of recrystallized SiC.

Example 15

In Example 15, an electrode member forming raw material was directly thermally sprayed to a side face of a honeycomb fired body without forming a conductive intermediate layer on the side face of the honeycomb fired body, to form electrode members. In a forming method of the electrode members, the procedure of Example 1 was repeated.

As to the electrode members of honeycomb structure of each of Examples 2 to 15 and Comparative Examples 1, 2 and 4, "a main component" of a composite material which is comprised the electrode members, "an amount (volume %) of Si", "an amount (ppm) of B to be doped" and "another component" were measured. Table 1 shows the result. Additionally, the electrode members of the honeycomb structure of Comparative Example 4 were substantially made of silicon, and its material was not the composite material.

As to the honeycomb structure of each of Examples 2 to 15 and Comparative Examples 1 to 4, an electric resistivity of the electrode member, an electric resistivity of the electrode member after a heat treatment, and a thermal expansion coefficient of the electrode member were measured. Table 1 shows the result. Furthermore, as to the honeycomb structure of each of Examples 2 to 15 and Comparative Examples 1 to 4, an energization durability test was carried out. Table 1 shows the result.

Result

As shown in Table 1, in all the honeycomb structures of Examples 1 to 15, suitable results were obtained in energization durability tests. Furthermore, it has been found that in all the honeycomb structures of Examples 1 to 15, an electric resistivity of the electrode member after a heat treatment was low and the electrode members were excellent in energization durability. That is, even when the electrode members of the honeycomb structure of each of Examples 1 to 15 receive thermal load by heat generation due to periodically repeated current supplying, the electrode members are hard to be peeled from the honeycomb structure body, and a deterioration and the like of the electrode members are effectively prevented.

On the other hand, in all the honeycomb structures of Comparative Examples 1 to 4, cracks of electrode members were confirmed in the energization durability test. In the honeycomb structure of Comparative Example 1, an amount of B to be doped in Si was 10070 ppm, and a volume ratio of this silicon was 39.7 volume %, and hence it is considered that the thermal expansion coefficient of the electrode member increased to cause the cracks of the electrode members.

In the honeycomb structure of Comparative Example 2, an amount of B to be doped in Si was 1730 ppm. However, a volume ratio of such a silicon was 39.7 volume %, and hence it is considered that the electric resistivity of the electrode member after the heat treatment remarkably increased to cause deterioration of the electrode members due to thermal load.

The honeycomb structure of Comparative Example 3 included electrode members made of NiCr. In the honeycomb structure of Comparative Example 3, it is considered that the electric resistivity of the electrode member after the heat treatment remarkably increased to cause the deterioration of the electrode members due to the thermal load. Furthermore, the honeycomb structure of Comparative Example 3 had a large thermal expansion coefficient of the electrode member.

In the honeycomb structure of Comparative Example 4, a composite material which is comprised electrode members was substantially made of silicon, and an amount of B to be doped was 30 ppm. The electrode members made of this silicon had large values in both an electric resistivity and an electric resistivity of the electrode member after a heat treatment. Further, in the honeycomb structure of Comparative Example 4, it has been found that the electric resistivity of the electrode member after the heat treatment decreased more noticeably than that before the heat treatment and that an oxidation resistance to the thermal load was remarkably low.

A honeycomb structure of the present invention can be suitably used as a catalyst carrier for an exhaust gas purification device to purify an exhaust gas of a car.

DESCRIPTION OF REFERENCE NUMERALS

1: partition wall, 2: cell, 3: circumferential wall, 4: honeycomb structure body, 5: side face, 11: first end face, 12: second end face, 21: electrode member, 21*a*: end portion (one end portion of the electrode member), 21*b*: end portion (the other end portion of the electrode member), 22: electrode terminal projecting portion, 22*a*: substrate, 22*b*: projecting portion, 23: conductive intermediate layer, 100, 200, 300 and 400: honeycomb structure, O: center, α: central angle, and θ: angle of 0.5 times of the central angle.

What is claimed is:

1. A honeycomb structure comprising: a pillar-shaped honeycomb structure body; and a pair of electrode members disposed on the side of a side face of the honeycomb structure body, wherein the honeycomb structure body has porous partition walls and a circumferential wall disposed at an outermost circumference, in the honeycomb structure body, the partition walls define a plurality of cells extending from a first end face of the honeycomb structure body to a second end face thereof, the honeycomb structure body is made of a material containing silicon carbide, and the pair of electrode members contains silicon and boron, at least a part of each electrode member is made of a composite material including silicon containing 100 to 10000 ppm of boron in silicon, as a main component, and at least one of a metal boride and a boride, in the composite material, a volume ratio of the silicon containing 100 to 10000 ppm of the boron in the composite material is 70 volume % or more, and an electric resistivity of the electrode members made of the composite material is from 20 μΩcm to 0.1 Ωcm.

2. The honeycomb structure according to claim 1, wherein the electric resistivity of the electrode member is from 0.001 to 0.1 Ωcm after a heat treatment is performed at 1000° C. of an atmospheric temperature for 72 hours.

3. The honeycomb structure according to claim 1, wherein a thermal expansion coefficient of the electrode member is from 3.0 to $6.5\times10^{-6}$/K.

4. The honeycomb structure according to claim 1, wherein the metal boride is at least one selected from the group consisting of CrB, $CrB_2$, $ZrB_2$, $TaB_2$, $NbB_2$, WB, and MoB.

5. The honeycomb structure according to claim 1, wherein the boride is at least one of BN and $B_4C$.

6. The honeycomb structure according to claim 1, further comprising:

a conductive intermediate layer made of a material containing at least one of silicon carbide and metal silicon between the side face of the honeycomb structure body and the electrode member.

7. The honeycomb structure according to claim 6, wherein an electric resistivity of the conductive intermediate layer is from 20 μΩcm to 5 Ωcm.

8. The honeycomb structure according to claim 1, wherein in the honeycomb structure body, a porosity is from 30 to 60%, an average pore diameter is from 2 to 15 μm, a thickness of the partition walls is from 50 to 300 μm, a cell density is from 40 to 150 cells/$cm^2$, and an electric resistance between the pair of electrode members is from 0.1 to 100Ω.

9. A manufacturing method of a honeycomb structure according to claim 1, comprising:

a step of thermally spraying or applying an electrode member forming raw material to the side of a side face of a pillar-shaped honeycomb formed body or a honeycomb fired body obtained by firing the honeycomb formed body to form electrode members on the side of the side face of the honeycomb formed body or the honeycomb fired body, wherein a mixture including solid silicon and powder of at least one of a metal boride and a boride is used as the electrode member forming raw material, and the mixture is thermally sprayed, or the applied mixture is heated at a temperature of 1400° C. or more to melt silicon in the mixture, thereby to form the electrode members.

10. The honeycomb structure according to claim 2, wherein a thermal expansion coefficient of the electrode member is from 3.0 to $6.5\times10^{-6}$/K.

* * * * *